United States Patent [19]

Chung-Hsing

[11] Patent Number: 4,893,528

[45] Date of Patent: Jan. 16, 1990

[54] ADJUSTABLE SPANNER

[76] Inventor: Chang Chung-Hsing, No. 5, Chang Ma Street, Ma Hsing Village, Shiow Showi Shi, Chang Huah, Taiwan

[21] Appl. No.: 326,342

[22] Filed: Mar. 21, 1989

[51] Int. Cl.[4] ..... B25B 13/28

[52] U.S. Cl. ..... 81/100

[58] Field of Search ..... 81/94, 97, 99, 100–104, 81/417, 407, 408, 411–413, 409.5

[56] References Cited

U.S. PATENT DOCUMENTS

| | | | |
|---|---|---|---|
| 1,500,314 | 7/1924 | Hacheney | 81/100 |
| 1,900,358 | 3/1933 | Mead | 81/100 |
| 4,753,140 | 6/1988 | Majima | 81/100 |

FOREIGN PATENT DOCUMENTS

| | | | |
|---|---|---|---|
| 155130 | 12/1920 | United Kingdom | 81/100 |
| 494078 | 10/1938 | United Kingdom | 81/100 |

*Primary Examiner*—D. S. Meislin

*Attorney, Agent, or Firm*—Browdy & Neimark

[57] ABSTRACT

An adjustable spanner includes a handle having a mounting end having a pressure edge and a thinned portion, a movable piece having a multi-angular surface capable of cooperating with the pressure edge to grip therebetween a tubular article and an engaging portion which by means of a pivoting medium is slidably and pivotably mounted on the thinned portion, and a positioning elastic piece having a first end fixed to the handle and a second opposite end engaging with the movable piece.

8 Claims, 4 Drawing Sheets

ADJUSTABLE SPANNER

BACKGROUND OF THE INVENTION

The present invention relates to a spanner, and more particularly to an adjustable spanner.

Different kinds of spanners are required to respectively screw on and off different threaded connecting pieces, e.g. a bolt and a tube joint . . . etc. Different sizes of spanners of the same kind are also required to screw on and off different sizes of threaded connecting pieces of the same kind. It goes without saying that such situation is troublesome and inconvenient for a user.

SUMMARY OF THE INVENTION

It is therefore an object of the present invention to provide an adjustable spanner capable of screwing on and of different kinds of threaded connecting pieces having a size ranged within a limited scope in order to reduce the tool cost and to obtain an operating convenience for the user.

According to the present invention, an adjustable spanner includes a handle having a mounting end which includes an upper nose portion having a pressure edge and a lower thinned portion defining at the bottom of the nose portion a first wall and a second wall inclined with respect to the first wall, a movable piece having an upper gripping portion having an inward multi-angular surface capable of cooperating with the pressure edge to grip therebetween a tubular article and a lower engaging portion which is slidably and pivotably mounted on the thinned portion and includes a groove defining therein a plurality of indentations and a side wall capable of flushly engaging with either one of the first and second walls, and a pivoting medium capable of selectively passing through one of the indentations to pivotably mount together the lower engaging portion and the thinned portion.

BRIEF DESCRIPTION OF THE DRAWING

The present invention may best be understood through the following description with reference to the accompanying drawings, in which.

DETAILED DESCRIPTION OF THE PREFERRED EMBODIMENT

Figure 2:
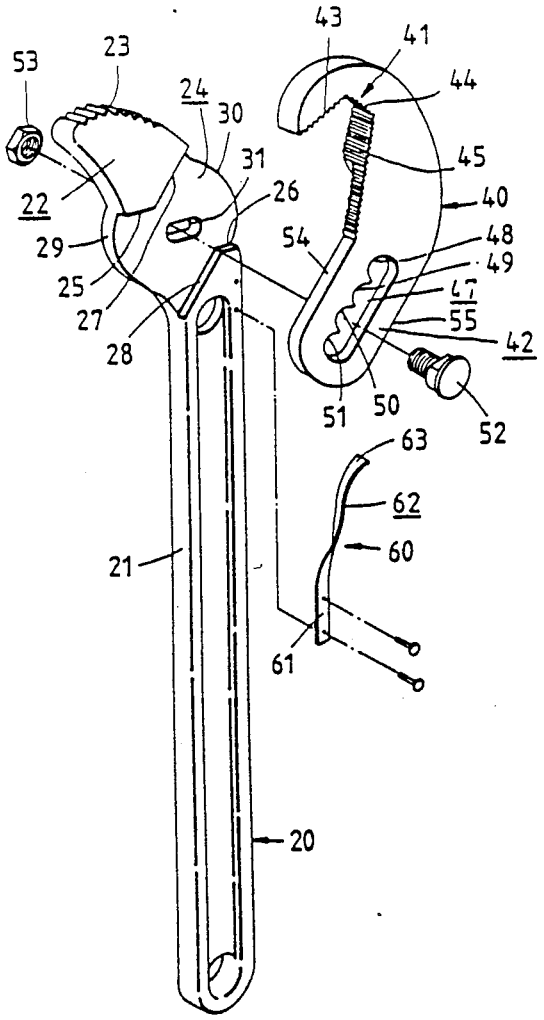
FIG. 2 is an exploded view showing an adjustable spanner in FIG. 1.
Figure 1:
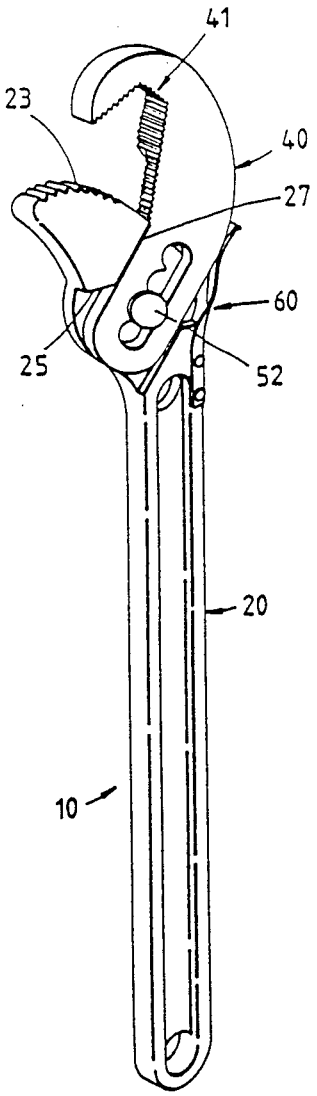
FIG. 1 is a perspective view showing a preferred embodiment of an adjustable spanner according to the present invention.

Referring now to FIGS. 1 & 2, an adjustable spanner 10 according to the present invention includes a handle 20, a movable piece 40 and a positioning elastic piece 60. Handle 20 includes a shank portion 21 and a mounting end which includes an upper nose portion 22 having a toothed pressure edge 23 and a lower thinned portion 24 respectively defining at nose portion 22 and shank portion 21 two parallel first walls 25, 26 and two parallel second walls 27, 28 respectively inclined with respect to first walls 25, 26. Thinned portion 24 includes a central elongated hole 31 and two widened sides 29, 30 in order to increase its strength.

Movable piece 40 includes an upper gripping portion 41 and a lower engaging portion 42 having a groove 47 defining therein 4 continuous arcuate indentation 48, 49, 50, 51 and two side walls 54, 55 respectively capable of flushly engaging with first walls 25, 26 or second walls 27, 28, Gripping portion 41 includes an inward toothed multi-angular surface having 3 continuous sides 43, 44, 45 with sides 43, 44 and sides 44, 45 both including an angle of about 120°. A pivoting medium being a specially machined bolt 52 in the present embodiment is capable of selectively passing through one of indentations 48–51 and passing through elongated hole 31 to be threaded by a nut 53 on its free end in order to pivotably and slidably mount together lower engaging portion 42 and thinned portion 24 in the manner that when side wall 54 flushly engages with second wall 27, toothed sides 43, 44, 45 and toothed pressure edge 23 are ready to cooperate with each other to clamp there-between a tubular article, e.g. a nut or a threaded tube joint; when movable piece 40 is pivoted along bolt 52 with respect to handle 20, the size of the space formed among pressure edge 23 and sides 43, 44, 45 is accordingly adjusted to cope with tubular articles of slightly different sizes; when side wall 54 flushly matchs against first wall 25, engaging portion 42 is slidable on thinned portion 24 to allow the pivoting medium to be positioned in any one of indentations 48–51 at one's desire.

Elastic piece 60 being strip-shaped includes a first end 61 riveted to shank portion 21 and a second 90°-twisted end 62 having an engaging section 63 engaging with side wall 55 of movable piece 40 for always urging side wall 54 against second wall 27 if there is not a foreign force applied to movable piece 40.

Figure 3:
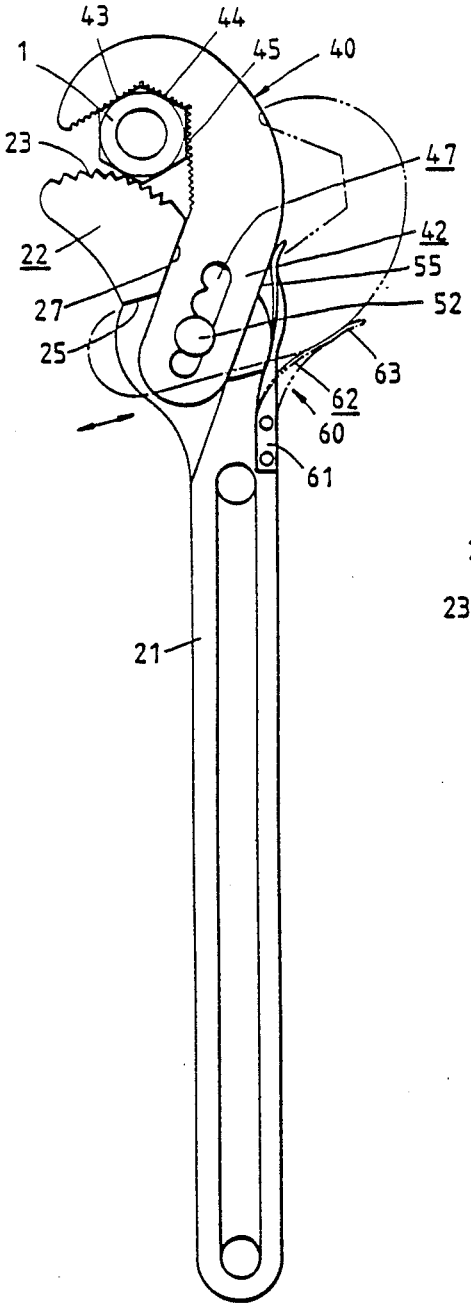
FIG. 3 is a front view schematically showing an adjustable spanner in FIG. 1 in use.

As shown in FIG. 3, if the present spanner 10 is to rotate a hexagonal nut 1, engaging portion 42 is slid on thinned portion 24 to position the pivoting bolt 52 in indentation 50. After slightly clockwise pivoting movable piece 40 in order to locate nut 1 among sides 43, 44, 45 and pressure edge 23, the clockwise rotation of shank portion 21 will respectively induce at sides 43, 44, 45 and pressure edge 23 clamping forces upon nut 1 to automatically tightly clamp there-between nut 1 in order that nut 1 can be clockwise rotated by the present spanner 10. If the size of the space formed among pressure edge 23 and sides 43, 44, 45 is to be adjusted, movable piece 40 is clockwise pivoted along bolt 52 with respect to handle 20 until side wall 54 flushly matchs against first wall 25, engaging portion 42 is slidable on thinned portion 24 to desiredly position pivoting bolt 52 in one of indentations 48–51 and side wall 54 will match against second wall 27 again if the foreign force applied to movable piece 40 is released by the provision of elastic piece 60.

Figure 4:
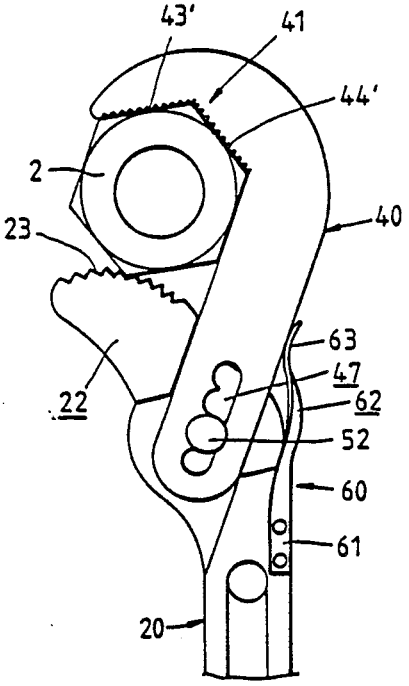
FIG. 4 is a front view showing the relevant part of further a preferred embodiment of an adjustable spanner according to the present invention.

As shown in FIG. 4, the multi-angular surface of gripping portion 41 can only include two continuous toothed sides 43', 44' including an angle of also about 120° in order that sides 43, 44 and pressure edge 23 can clamp there-between a nut 2 having a relatively large size.

Figure 5:
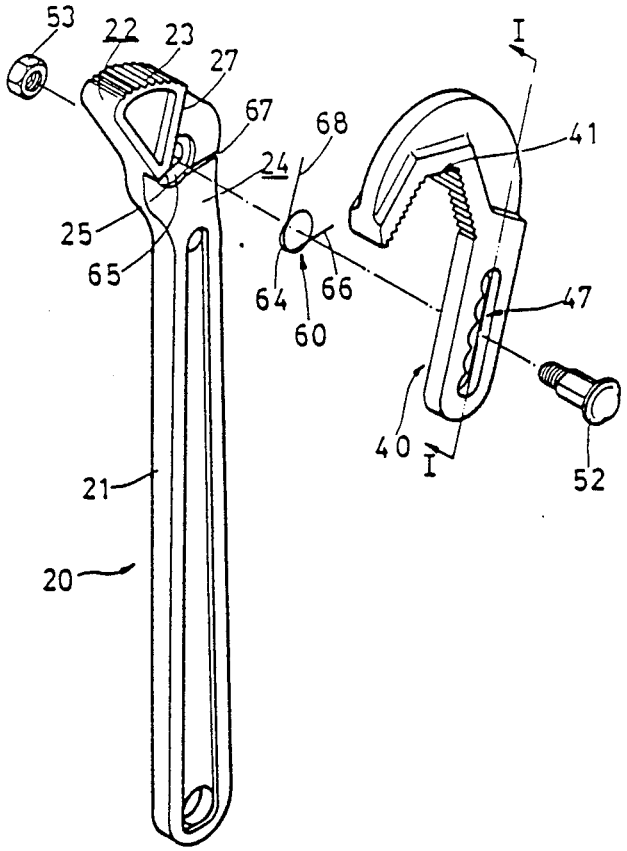
FIG. 5 is an exploded view showing additional a preferred embodiment of an adjustable spanner according to the present invention.
Figure 6:
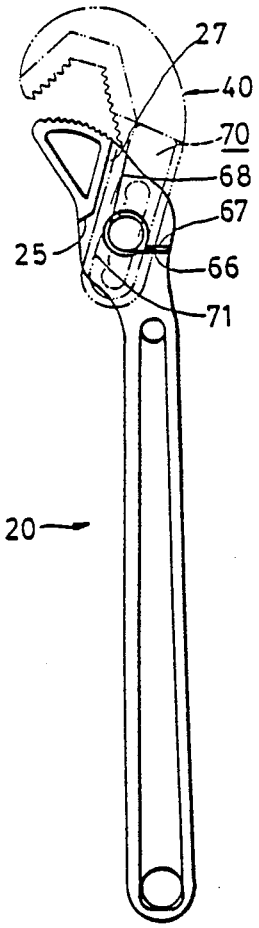
FIG. 6 is a schematically front view showing an adjustable spanner in FIG. 5.
Figure 7:
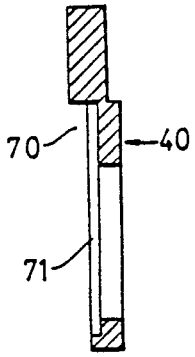
FIG. 7 is a sectional view, taken along line I—I in FIG. 5, showing a movable piece for an adjustable spanner in FIG. 5.

As shown in FIGS. 5–7 showing a further preferred embodiment of the present adjustable spanner, elastic piece 60 can be a torsional spring which includes a body portion 64 received in a circular room 65 provided around elongated hole 31, a first free end 66 retainedly fixed in a slit 67 communicating with room 65, and a second free end 68 urging aginst a side wall 71 defining one side of a rectangular room 70 communicating with groove 47 so that side wall 54 is always urged against second wall 27 if there is not an external force applied to movable piece 40. It can be noticed that handle 20 and movable piece 40 can be differently shaped as shown without departing from the spirit of the present invention.

What I claim is:

1. An adjustable spanner comprising:

a handle having a mounting end which includes an upper nose portion having a pressure edge, and a lower thinned portion defining, at a bottom of said nose portion, a first wall and a second wall, said second wall being inclined with respect to said first wall;

a movable piece having an upper gripping portion have an inward multi-angular surface capable of cooperating with said pressure edge to grip therebetween a tubular article, and a lower engaging portion which is slidably and pivotably mounted on said thinned portion and includes a groove defining therein a plurality of indentations and a side wall means for flushly engaging with either one of said first and second walls; and a pivot means extending through said groove for selectively engaging one of said indentations and for pivotally mounting said lower engaging portion to said thinned portion, wherein when said side wall means flushly engages with said second wall, said multi-angular surface and said pressure edge are ready to clamp therebetween said tubular article, when said movable piece is pivoted with respect to said handle, the size of a space formed between said pressure edge and said multi-angular surface is accordingly adjusted, and when said side wall flushly matches against said first wall, said engaging portion is slidable on said thinned portion to allow said pivoting medium to be positioned in any one of said indentations.

2. An adjustable spanner according to claim 1 wherein said pressure edge and said multi-angular surface are toothed.

3. An adjustable spanner according to claim 1, further comprising a positioning elastic piece having a first end fixed to said handle and a second opposite end engaging with said movable piece for always urging said side wall means against said second wall.

4. An adjustable spanner according to claim 3 wherein said elastic piece is a strip-shaped spring.

5. An adjustable spanner according to claim 3 wherein said elastic piece is a torsional spring having two free ends forming said first and second end.

6. An adjustable spanner according to claim 5 wherein said thinned portion includes a circular room for receiving therein a body portion of said torsional spring.

7. An adjustable spanner according to claim 6 wherein said thinned portion further includes a slit communicating with said circular room for retainingly fixing therein said first end.

8. An adjustable spanner according to claim 7 wherein said lower engaging portion further includes a rectangular room communicating with said groove in which a side wall defining said rectangular room engages with said second end.

* * * * *